United States Patent [19]

Greer

[11] Patent Number: 4,706,561

[45] Date of Patent: Nov. 17, 1987

[54] PRINTING ACTIVATOR TEST CIRCUIT GENERATING BACK EMF

[75] Inventor: Jerry L. Greer, Waynesboro, Va.

[73] Assignee: Genicom Corporation, Waynesboro, Va.

[21] Appl. No.: 850,436

[22] Filed: Apr. 8, 1986

Related U.S. Application Data

[63] Continuation of Ser. No. 664,878, Oct. 25, 1984, abandoned.

[51] Int. Cl.[4] ..... B41J 9/38

[52] U.S. Cl. ..... 101/93.01; 101/93.29; 400/54; 400/157.2; 361/157; 324/59; 324/73 R; 340/664; 340/515

[58] Field of Search ..... 101/93.29, 426, 93.01, 101/54; 400/157.3, 157.2, 121, 124; 361/152, 159; 324/51, 57 R, 59, 263, 19.4 R, 150 A, 151 R, 73 R–73 AT; 340/659, 664, 515–516; 371/28

[56] References Cited

U.S. PATENT DOCUMENTS

| | | | |
|---|---|---|---|
| 3,573,562 | 4/1971 | Hanson | 361/159 |
| 3,740,615 | 6/1973 | Vigini | 400/54 X |
| 3,742,310 | 6/1973 | Ehrat | 361/159 |
| 3,909,681 | 9/1975 | Camparl et al. | 400/157.2 |
| 4,177,731 | 12/1979 | Kleist et al. | 400/121 X |
| 4,293,888 | 10/1981 | McCarty | 361/152 |
| 4,317,412 | 3/1982 | Bolcavage et al. | 101/93.29 |
| 4,339,208 | 7/1982 | Biedermann | 400/124 |
| 4,353,656 | 10/1982 | Sohl et al. | 400/157.3 |
| 4,381,532 | 4/1983 | Arnold | 361/152 |
| 4,411,540 | 10/1983 | Nozaki et al. | 400/54 X |
| 4,556,926 | 12/1985 | Yanagida | 361/152 X |
| 4,579,467 | 4/1986 | Furukawa | 400/54 |
| 4,595,935 | 6/1986 | Brooks et al. | 400/54 |
| 4,612,638 | 9/1986 | Kissel | 324/73 R X |
| 4,649,341 | 3/1987 | Ulbricht | 324/59 X |

FOREIGN PATENT DOCUMENTS

| | | | |
|---|---|---|---|
| 1234564 | 6/1971 | United Kingdom | 324/59 |

*Primary Examiner*—E. H. Eickholt
*Attorney, Agent, or Firm*—Nixon & Vanderhye

[57] ABSTRACT

Detecting the inoperability of a plurality of printing element drivers without printing involving sequentially energizing each of the drivers with a shortened time duration pulse sufficient to produce a signal in indicating operability and/or inoperability but not sufficient to cause printing.

5 Claims, 5 Drawing Figures

PRINTING ACTIVATOR TEST CIRCUIT GENERATING BACK EMF

This is a continuation of application Ser. No. 664,878, filed Oct. 25, 1984, abandoned.

BACKGROUND OF THE INVENTION

The present invention relates to a print activator test circuit and particularly to testing the operativeness or inoperativeness of electrical circuits involved in a printing operation without actually effecting printing during the test process.

In printers where a mechanical member such as a print wire is actuated by an electromagnet, it may be of paramount importance to provide means for checking that electrical circuits involved in actuating the printing elements are in an operative state. Where the actuating apparatus involves electromagnets, it is important to determine before printing commences that an open or shorted coil exists. It is desirable that this test of operativeness occur without having dots or other indicia printed during the test process.

Arrangements are known whereby the accomplishment of the above testing is checked by independent detecting members sensitive, for example, to mechanical motions of such apparatus as printing styli, optical or piezoelectric moving elements or the like. Unfortunately, these types of arrangements are complex and expensive, especially in the case of high speed parallel printing where the number of actuators is very high. In case of serial printers, for example of the dot matrix type, a plurality of stylus drivers are employed and the same problems and considerations are involved. The result of these aforementioned schemes is that it involves a multiplicity of independent detection means, mechanical connections of undue complexity, increased weight, increased space requirements and masking by failures occurring in other parts of the system.

The object of the invention is to obviate such problems by providing a control arrangement for detecting the operativeness of an electrical circuit by employing a driving signal of shortened duration sufficient to produce a driver signal output to indicate operativeness or inoperativeness but not sufficient to cause printing by an associated printing element and a common detection means.

SUMMARY OF THE INVENTION

The above object is attained, according to the invention, in one embodiment involving the detection of the operability of a plurality of printing element drivers employed for activating respective printing elements for printing along a print line on a record medium without causing printing. This arrangement comprises means for sequentially energizing each of said drivers with a shortened duration drive pulse sufficient to produce a reverse electromotive force signal in an associated coil but not sufficient to cause printing by an associated printing element. Means are then provided for detecting the effective absence of said reverse electromotive force signal indicating an inoperative coil driver or an open or shorted coil during determination of each such sequential energizing. This detection results in an error signal which is then used to produce an information signal indicative of coil and/or coil driver inoperativeness.

BRIEF DESCRIPTION OF THE DRAWINGS

The following detailed description of the preferred embodiment will be better understood by referring to the attached drawings in which.

DESCRIPTION OF A PREFERRED EMBODIMENT

Figure 1:
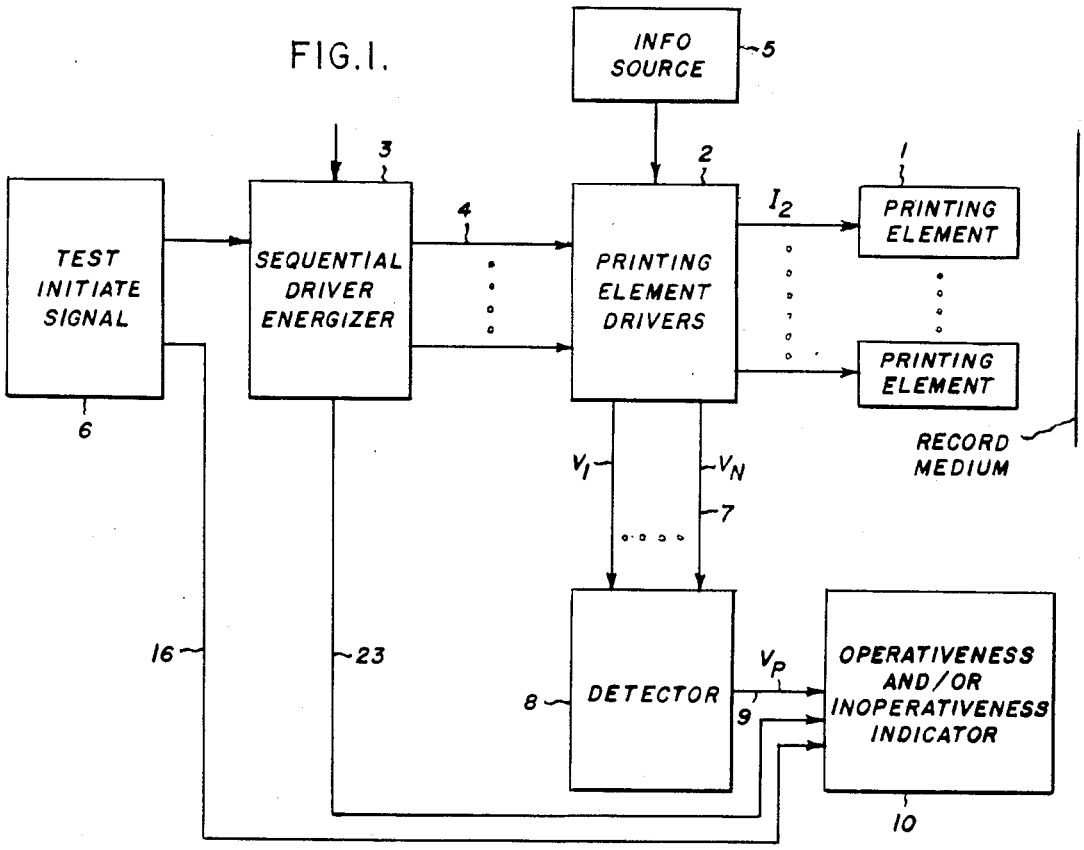
FIG. 1 illustrates in block diagram form the overall invention for detecting the operativeness or inoperativeness of coil driver circuits used in a printer.

Referring to FIG. 1 there is shown in simplified block diagram form the details of the present invention. Normally in a printer involving printing elements such as dot matrix print styli, there is a need to test the driving circuitry to determine inoperativeness or operativeness. This arises from the fact that the printers operate at high speed and it is desirable to run a test before the equipment, oftentimes unattended, is permitted to print. In FIG. 1 there is shown a plurality of printing elements 1 which in the case of styli would be driven towards a record medium as, for example, paper, and cause printing to take place via an inked ribbon which is not shown but is placed between the record medium and the printing element. The number of printing elements depends on the number of dots desired to be printed in a vertical line in the case of a serial printer and in a horizontal line in the case of a shuttle printer. Each of the printer elements is driven by a respective printing element driver which in one embodiment involves a solenoidal coil actuator. Signals applied to each of the coils of the drivers causes a magnetic field to drive the associated stylus into the record medium. In order to excite the drivers, there is provided a sequential driver energizer 3 which operates to sequentially apply signals over respective leads 4 to each of the printing element drivers 2. The use of the sequential driving signals for test purposes offers certain advantages. For example, by sequentially energizing the drivers for detecting their oerativeness or inoperativeness, a sequential output signal can be obtained to indicate the state of operativeness of the individual energized drivers. These sequential output signals can be detected by a single detector circuit. Thus each individual driver does not require a separate detector. In the arrangement shown, printing normally takes place under the control of signals supplied from an information source 5. The manner in which this is accomplished is well known in the art. In the present application in order to test the operativeness of the printing element drivers 2, a test initiate signal is generated under operator or remote control in block 6. This test initiate signal applied to the sequential driver energizer 3 causes test pulses to be sequentially applied over each of the leads 4 to the associated printing element drivers 2. These test pulses are of shorter duration than the normal print actuation pulses in order to obtain a signal of operativenss or inoperativeness of the drivers 2 without actually causing printing by the printing elements 1. This will be described in greater detail later.

Figure 5:
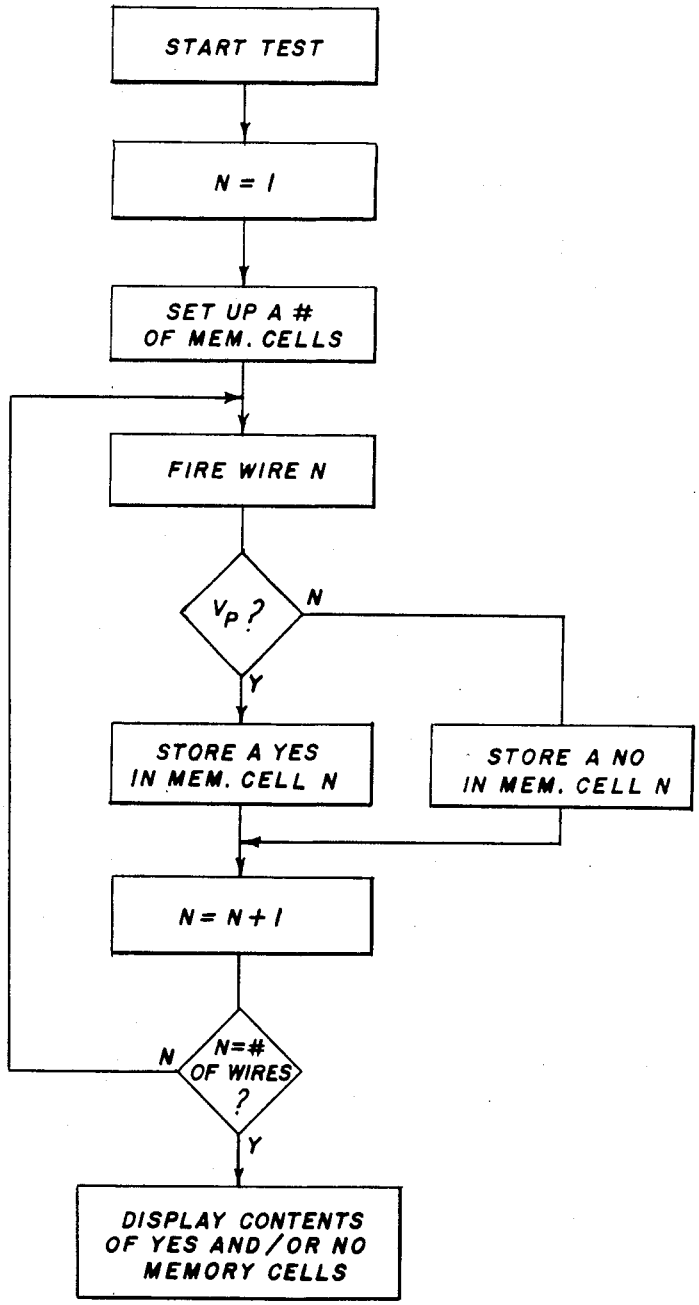

In any event, upon operating in response to the test initiate signals from 6, the printing element drivers 2 produce output signals $V_{1-N}$ on lead 7 indicating the operativeness or inoperativeness of the respective driver elements in 2. These signals on 7 are detected by a detector 8 which then supplies an indication signal $V_p$ over lead 9 to the indicator 10 to indicate the operativeness and/or inoperativeness of the individual printing element drivers 2. In a particular embodiment the indicator 10 may be a numerical display which indicates, numerically, which ones of the driver elements 2 are operative or inoperative, or may simply produce a signal indicating there exists an inoperative driver. The details of how these indications can be obtained are well known in the art. In a particular software embodiment, illustrated in FIG. 5 there is described a program in flow chart form for indicating which, if any, of the individual printing element drivers tested operative or inoperative. It is sufficient for purposes of this discussion to say that 10 produces an indication of the operativeness or inoperativeness of the individual element drivers 2.

Figure 2:
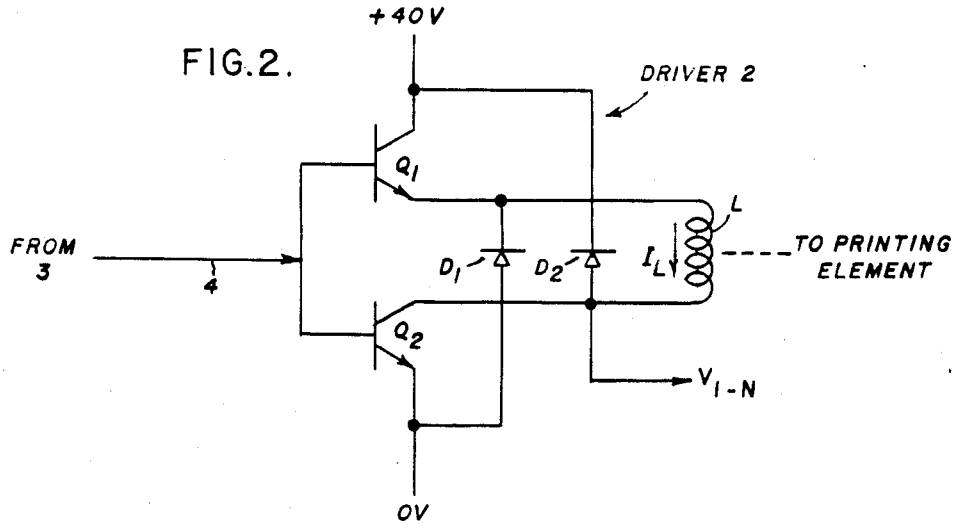
FIG. 2 illustrates in circuit diagram form the details of the driver elements used to activate the printing elements. The number of such driver circuits would correspond to the number of printing elements.

Referring to FIG. 2 there is shown in greater detail one embodiment of a driver circuit 2. The drive signals available from 3 are shown being applied to one particular driver circuit 2 shown in FIG. 2. This would be a pulse of 250 microseconds duration applied over lead 4 to the driver, through transistors Q1 and Q2 producing a current in coil L, to effect printing. In one embodiment L was a solenoidal actuator. Q1 and Q2 are turned on and off in response to a signal on lead 4. FIG. 2 operates as a current regulating driver and produces current $I_L$ in coil L. FIG. 4A illustrates such a current in the first waveform segment 11. This regulated current waveform 11 consists of a pulse with an average amplitude of, in one example, the order of 2.4 amperes and a pulse width of 250 microseconds. This duration of current pulse is sufficient to cause printing to take place but is shortened as will be described shortly when a test operation is desired. The diodes D1 and D2 clamp the reverse electromotive force produced by the coil L at the end of the drive pulse to the 40 volts and remove stored energy from the coil quickly. The output signal $V_{1-N}$ produced at the output of the driver in FIG. 2 is shown in greater detail in FIG. 4B in waveform segment 12 for the normal printing operation. The polarity of the voltage is positive with respect to the other end of the coil. Thus diodes D1 and D2 become forward biased and the coil discharges into the voltage supply. The resulting voltage,waveform $V_{1-N}$ is shown in FIG. 4B as segment 12. A shorted or open coil would not allow $V_{1-N}$ to connect to the plus 40 V supply through D2.

Figure 3:
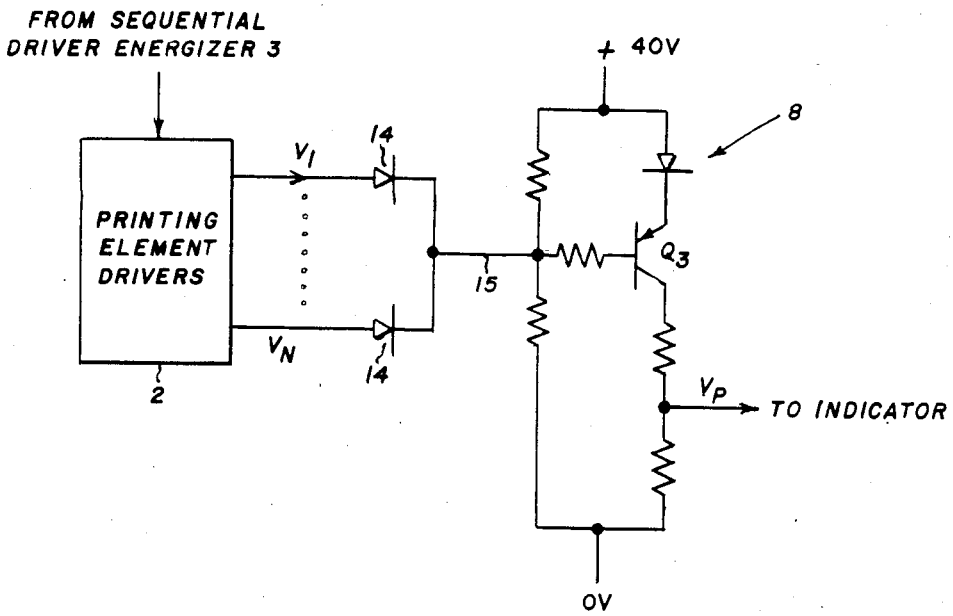
FIG. 3 illustrates in block diagram and schematic form the details of the detector mentioned in FIG. 1.

Reference is now made to FIG. 3 to indicate how the $V_{1-N}$ pulses are detected to produce an indication in 10. One embodiment of a detector 8 as shown in FIG. 3 consists of individual diodes coupling the $V_{1-N}$ signals to a detector circuit. The $V_{1-N}$ signals available from the output of the driver 2 and ORed by the input diodes 14 onto lead 15 before application to the detector circuit. It should be noted that only one detector circuit is required for 1 to N driver circuits. The voltage on 15 is normally at a given level, say of the order of 36 volts. Q3 conducts and approximately 4.5 volts are then present at $V_p$. When a $V_{1-N}$ voltage forward biases the isolation diodes 14, the bus 15 voltage rises and Q3 "turns off". The voltage at $V_p$ goes to zero. Q3 turns on and $V_p$ returns the 4.5 volts when the $V_{1-N}$ voltage falls below 36 volts. The $V_p$ waveform is shown in FIG. 4 segment B.

Figure 4:
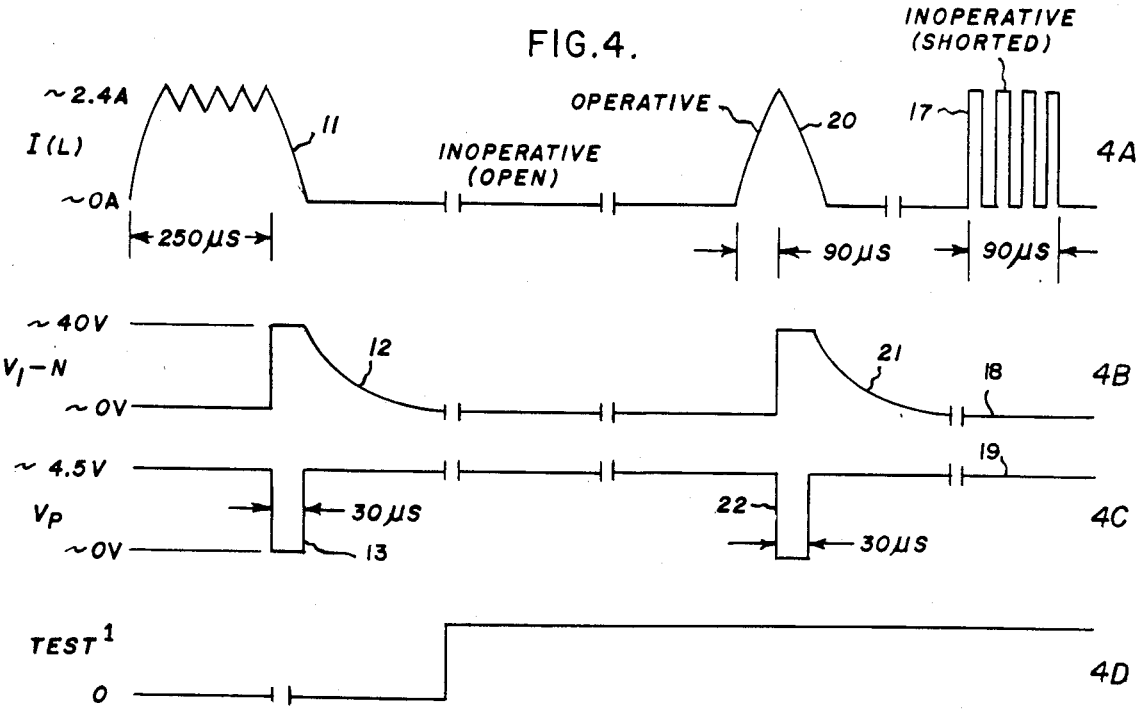
FIG. 4 illustrates graphically certain waveforms useful in explaining the operation of the invention.

In the case where normal printing is taking place because of the drive pulse 11 producing a $V_p$ signal 13 as shown in FIG. 4C, the indicator ignores this information when no test is being conducted. This is because a signal over lead 16 from the test initiate signal device 6 is applied to the indicator 10 to cause the indicator 10 to respond only to $V_p$ signals associated with the initiation of a test cycle as represented by the TEST signal shown in FIG. 4D. Thus far, we have considered the case of the normal printing arrangement in which a 250 microsecond current pulse as shown in FIG. 4A is flowing in the inductance L in FIG. 2. We will now consider the situation in which there is an inoperative coil as for example a coil that is open circuited. Under these circumstances as shown in FIG. 4 no current flows through the inductance L and therefore no reverse electromotive force is induced and no $V_p$ signal is developed by the detector 8. The indicator 10 would respond then to the test signal shown in FIG. 4D, the occurrence of the next driver energizer pulse from 3 over lead 23 and the absence of a signal $V_p$ to indicate inoperativeness as far as that particular coil driver is concerned. On the other hand, if the inoperativeness is due to a shorted coil, then the current flowing in the inductance L of FIG. 2 is shown at 17 in FIG. 4A. In essence, these are a series of pulses having a total duration of 90 microseconds. Under this circumstance the voltage $V_{1-N}$ for the shorted coil situation would be near zero as shown at 18 and the signal $V_P$ would also be 4.5 volts as shown at 19. The indicator would then indicate that there is an inoperative coil.

In the case where during the test program an operative coil is addressed, the current flowing in the inductance would be as shown in 20 in FIG. 4A producing a $V_{1-N}$ signal as shown at 21 in FIG. 4B which in turn produces a $V_p$ signal 22 as shown in FIG. 4C. The $V_{1-N}$ and $V_p$ pulses are essentially unchanged from the normal printing case. However, the printing elements, if a styles or wire, is not displaced enough to strike the paper and effect printing. Under this circumstance this negative going pulse is identified in the indicator 10 as an operative coil.

It should be noted that in order for the system to work, the coil driving signals are selected to be of 90 microseconds duration as shown in FIG. 4A as contrasted with he normal printing duration of 250 microseconds. During the 90 microsecond period there is an insufficient driving force developed to cause the printing elements to effect printing but there is sufficient signal information developed in the coil L to be detected to indicate an operative or an inoperative condition.

While the invention has been described in terms of a preferred embodiment, those skilled in the art will appreciated that there are many possible variations and modifications which may be made in the exemplary embodiment while retaining many features and advantages of the invention. For example, while the elements were described as involving dot matrix print wires, the invention is equally applicable to systems in which printing is effected by fully formed characters or by nonimpact means such as thermal printers or magnetic printers. It is sufficient that an electrical circuit exists that is associated with effecting printing which circuit can then be tested in accordance with the teachings of the present invention. Accordingly, all such modifications and variations are intended to be included within the scope of the following claims.

What I claim as new and desire to secure by Letters Patent of the United States is:

1. In a printing arrangement, a plurality of printing elements arranged to effect printing along a line on a record medium, respective printing element actuators for each of said printing elements, each of said actuators comprising an electrical inductive circuit responsive to print information available from a source and a driving signal pulse to effect printing of indices by selected printing elements corresponding to said print information, means for detecting the inoperativeness of said electrical inductive circuits due to open or short circuit conditions, said detecting means comprising means for sequentially energizing each of said electrical inductive circuits with a driven signal pulse of reduced time duration insufficient to cause printing by said electrical inductive circuits but sufficient to produce a first detectable reverse electromotive force signal condition therein if the circuit is operative and a second different electromotive force signal condition if the circuit is inoperative, and a common detection circuit coupled to said electrical inductive circuits for sequentially detecting said reverse electromotive force signal conditions and means responsive to detection of said reverse electromotive force conditions to indicate which of said electrical inductive circuits are operative and which are inoperative.

2. An arrangement for detecting the operability of a plurality of inductive printing element drivers employed for activating respective printing elements for printing along a print line on a record medium without causing printing comprising:

means for sequentially energizing each of said drivers with a shortened duration signal sufficient to produce respective reverse electromagnetic force driver signal outputs but not sufficient to cause printing by the associated printing element, common means for detecting the effective absence of reverse electromotive force driver signal outputs indicating an inoperative driver during each sequential energizing to produce an error signal, and signal means responsive to said error signal to produce an information signal.

3. An arrangement for detecting the operability of a plurality of coil drivers employed for actuating respective printing elements for impact printing along a print line on a record medium without causing printing, comprising means for sequentially energizing each of said coil drivers with a shortened duration drive pulse sufficient to produce a reverse electromotive force signal in such coils but not sufficient to cause printing by an associated printing element, a common means for detecting the effective absence of said reverse electromotive force signals indicating inoperative coil drivers during the termination of each such sequential energizing to produce error signals, and signal means responsive to said error signal to produce an information signal.

4. A method for detecting the operative condition of a plurality of inductive coil print element driver circuits without actually causing a complete printing operation, said method comprising the steps of:

energizing each print element driver circuit with an electrical test signal incapable of actually causing a complete printing operation, detecting a respective reverse electromotive force signal produced from each of said circuits in response to energization with said test signal; and determining from said detected reverse electromotive force signals whether each said circuit is not open and not-shorted.

5. Apparatus for detecting the operative or inoperative condition of a plurality of inductive coil print element driver circuits without actually causing a complete printing operation, said apparatus comprising:

means for energizing each print element driver circuit with an electrical test signal incapable of actually causing a complete printing operation; and means for detecting whether a respective, predetermined reverse electromotive force signal is produced from each said circuit in response to energization with said test signal as is expected if the circuit is not-open, not-shorted and operative.

* * * * *